US009121281B2

(12) United States Patent
Sadamitsu et al.

(10) Patent No.: US 9,121,281 B2
(45) Date of Patent: Sep. 1, 2015

(54) TURBOCHARGER AND TURBOCHARGER WHEEL HOUSING

(75) Inventors: Takahiro Sadamitsu, Nisshin (JP); Tatsuo Iida, Anjo (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 653 days.

(21) Appl. No.: 13/574,648

(22) PCT Filed: Feb. 2, 2011

(86) PCT No.: PCT/IB2011/000309

§ 371 (c)(1),
(2), (4) Date: Jul. 23, 2012

(87) PCT Pub. No.: WO2011/095892

PCT Pub. Date: Aug. 11, 2011

(65) Prior Publication Data

US 2012/0288364 A1 Nov. 15, 2012

(30) Foreign Application Priority Data

Feb. 4, 2010 (JP) ..... 2010-023404

(51) Int. Cl.
*F01D 9/02* (2006.01)
*F01D 21/04* (2006.01)

(52) U.S. Cl.
CPC ..... *F01D 9/026* (2013.01); *F01D 21/045* (2013.01); *F05D 2220/40* (2013.01)

(58) Field of Classification Search
CPC .... F01D 9/026; F01D 21/045; F05D 2220/40
USPC ..... 415/204–206, 9
See application file for complete search history.

(56) References Cited

U.S. PATENT DOCUMENTS

2007/0071605 A1 3/2007 Gazzillo et al.

FOREIGN PATENT DOCUMENTS

| | | | |
|---|---|---|---|
| CN | 1936276 | A | 3/2007 |
| DE | 100 28 160 | A1 | 12/2001 |
| JP | 10-110622 | A | 4/1998 |
| JP | 2003-536009 | A | 12/2003 |
| JP | 2007-002791 | A | 1/2007 |
| JP | 2008-106667 | A | 5/2008 |

OTHER PUBLICATIONS

International Search Report and Written Opinion for corresponding International Patent Application No. PCT/IB2011/000309 mailed Sep. 26, 2011.

*Primary Examiner* — Edward Look
*Assistant Examiner* — Jesse Prager
(74) *Attorney, Agent, or Firm* — Sughrue Mion, PLLC

(57) ABSTRACT

A turbine housing 11 includes a first shell body 40 in which a reinforcement portion 42 is superposed on an outer peripheral face 53A of a lateral wall portion 53 of a scroll portion. Further, a reinforcement portion having a slit portion 43 that is partially discontinuous in a circumferential direction is provided as the reinforcement portion 42. Further, a shell body 30 and a base body 60 are combined with each other such that a pillar portion 65 is so located as to intersect with those ones of tangential lines T1, T2 of a turbine wheel 21 which pass a thin-walled portion 32A of the shell body 30, namely, such that the pillar portion 65 is located in a travel path of a fragment of the wheel 21 moving from a main body of the wheel 21 toward the thin-walled portion 32A.

27 Claims, 7 Drawing Sheets

TURBOCHARGER AND TURBOCHARGER WHEEL HOUSING

FIELD OF THE INVENTION

1. Field of the Invention

The invention relates to a turbocharger wheel housing that includes a shell body having a scroll portion and a base body having an accommodation portion in which a wheel is accommodated, with a gas passage formed between the shell body and the base body.

2. Background of the Invention

As a turbocharger wheel housing, there is known a turbine housing disclosed in Japanese Patent Application Publication No. 2008-106667 (JP-A-2008-106667). According to a sheet metal turbine housing such as this turbine housing, the thicknesses of respective wall portions can be made small in comparison with a cast turbine housing, so a reduction in weight and a reduction in thermal capacity can be achieved.

However, in the sheet metal housing, the following problem arises due to a small thickness of a shell body. That is, should part of a wheel separate from a main body as a fragment during rotation thereof and hit the shell body, a region hit by the fragment is greatly deformed as a result of the small thickness of the shell body. It should be noted that a similar problem may be caused not only in a sheet metal housing but also in any housing with a shell body whose lateral wall portion includes a thin-walled portion.

SUMMARY OF THE INVENTION

The invention provides a turbocharger and a wheel housing thereof that can restrain a shell body from being greatly deformed.

A first aspect of the invention relates to a turbocharger wheel housing. This wheel housing includes a shell body having a scroll portion and a base body having an accommodation portion in which a wheel is accommodated, and in which a gas passage formed between the shell body and the base body. The shell body is composed of a first shell body and a second shell body that are formed separately from each other and combined with each other. The second shell body includes the scroll portion. The accommodation portion includes a wheel chamber in which the wheel is arranged, a communication portion that allows a gas to flow from the gas passage to the wheel chamber, and a pillar portion provided adjacently to the communication portion to block flow of the gas from the gas passage to the wheel chamber. The first shell body includes a reinforcement portion superposed on one of an inner peripheral face or an outer peripheral face of a peripheral wall of the scroll portion. The reinforcement portion has a slit portion that is partially discontinuous in a circumferential direction. The pillar portion is provided on a travel path of a fragment of the wheel moving from a main body of the wheel toward the slit portion.

In this wheel housing, the reinforcement portion is superposed on the peripheral wall of the scroll portion. Therefore, the amount of deformation of the second shell body can be made small when the fragment of the wheel hits the peripheral wall of the scroll portion. Meanwhile, it is also conceivable that the reinforcement portion be structured not to include the slit portion. In the case of this structure, however, the operation of superposing the reinforcement portion on the peripheral wall of the scroll portion is troublesome in manufacturing the shell body. In the invention, the slit portion is provided through the reinforcement portion. Therefore, the operability in superposing the reinforcement portion on an inner peripheral face or an outer peripheral face of the peripheral wall of the scroll portion can be made good.

On the other hand, according to the structure of the shell body including the slit portion, that region of the second shell body which corresponds to the slit portion is not substantially reinforced by the reinforcement portion. Therefore, the second shell body is not sufficiently restrained from being deformed in this region. In the invention, the pillar portion is provided on the traveling path of the fragment of the wheel moving from the main body of the wheel toward the slit portion. Therefore, when separating from the main body of the wheel, the fragment of the wheel hits the pillar portion located between the wheel and the slit portion, and hence is unlikely to hit the slit portion. Thus, that region of the second shell body which corresponds to the slit portion can be restrained from being greatly deformed.

A second aspect of the invention relates to a turbocharger wheel housing. This wheel housing includes a shell body having a scroll portion and a base body having an accommodation portion in which a wheel is accommodated, and in which a gas passage formed between the shell body and the base body. The shell body is composed of a first shell body and a second shell body that are formed separately from each other and combined with each other. The second shell body includes the scroll portion. The accommodation portion includes a wheel chamber in which the wheel is arranged, a communication portion that allows a gas to flow from the gas passage to the wheel chamber, and a pillar portion provided adjacently to the communication portion to block flow of the gas from the gas passage to the wheel chamber. The first shell body includes a reinforcement portion superposed on one of an inner peripheral face or an outer peripheral face of a peripheral wall of the scroll portion. The reinforcement portion has a slit portion that is partially discontinuous in a circumferential direction. The pillar portion is so provided as to intersect with that tangential line of the wheel which passes the slit portion.

In this wheel housing, the reinforcement portion is superposed on the peripheral wall of the scroll portion. Therefore, the amount of deformation of the second shell body can be made small when the fragment of the wheel hits the peripheral wall of the scroll portion. Meanwhile, it is also conceivable that the reinforcement portion be structured not to include the slit portion. In the case of this structure, however, the operation of superposing the reinforcement portion on the peripheral wall of the scroll portion is troublesome in manufacturing the shell body. In the invention, the slit portion is provided through the reinforcement portion. Therefore, the operability in superposing the reinforcement portion on the inner peripheral face or the outer peripheral face of the peripheral wall of the scroll portion can be made good.

On the other hand, according to the structure of the shell body including the slit portion, that region of the second shell body which corresponds to the slit portion is not substantially reinforced by the reinforcement portion. Therefore, the second shell body is not sufficiently restrained from being deformed in this region. In the invention, the pillar portion is so provided as to intersect with that tangential line of the wheel which passes the slit portion, the wheel moving from the main body of the wheel toward the slit portion. Therefore, when separating from the main body of the wheel, the fragment of the wheel hits the pillar portion located between the wheel and the slit portion, and hence is unlikely to hit the slit portion. Thus, that region of the second shell body which corresponds to the slit portion can be restrained from being greatly deformed.

A third aspect of the invention relates to a turbocharger wheel housing. This wheel housing includes a shell body having a scroll portion and a base body having an accommodation portion in which a wheel is accommodated, and in which a gas passage formed between the shell body and the base body. The shell body is composed of a first shell body and a second shell body that are formed separately from each other and combined with each other. The second shell body includes the scroll portion. The accommodation portion includes a wheel chamber in which the wheel is arranged, a communication portion that allows a gas to flow from the gas passage to the wheel chamber, and a pillar portion provided adjacently to the communication portion to block flow of the gas from the gas passage to the wheel chamber. The first shell body includes a reinforcement portion superposed on one of an inner peripheral face or an outer peripheral face of a peripheral wall of the scroll portion. The reinforcement portion has a slit portion that is partially discontinuous in a circumferential direction. The pillar portion is so provided as to prevent a fragment of the wheel, which separates from a main body of the wheel and moves toward a thin-walled portion of a peripheral wall of the shell body, from hitting the thin-walled portion, the thin-walled portion being that region of the peripheral wall of the shell body where a peripheral wall of the scroll portion and the slit portion are superposed on each other.

In this wheel housing, the reinforcement portion is superposed on the peripheral wall of the scroll portion. Therefore, the amount of deformation of the second shell body can be made small when the fragment of the wheel hits the peripheral wall of the scroll portion. Meanwhile, it is also conceivable that the reinforcement portion be structured not to include the slit portion. In the case of this structure, however, the operation of superposing the reinforcement portion on the peripheral wall of the scroll portion is troublesome in manufacturing the shell body. In the invention, the slit portion is provided through, the reinforcement portion. Therefore, the operability in superposing the reinforcement portion on the inner peripheral face or the outer peripheral face of the peripheral wall of the scroll portion can be made good.

On the other hand, according to the structure of the shell body including the slit portion, that region of the second shell body which corresponds to the slit portion is not substantially reinforced by the reinforcement portion. Therefore, the second shell body is not sufficiently restrained from being deformed in this region. In the invention, the pillar portion is so provided as to prevent the fragment of the wheel, which moves from the main body of the wheel toward the slit portion, from hitting the thin-walled portion. Therefore, when separating from the main body of the wheel, the fragment of the wheel hits the pillar portion located between the wheel and the slit portion, and hence is unlikely to hit the slit portion. Thus, that region of the second shell body which corresponds to the slit portion can be restrained from being greatly deformed.

In the turbocharger wheel housing according to each of the foregoing aspects of the invention, the first shell body and the second shell body may be provided as sheet metal shell bodies.

In this wheel housing, the first shell body and the second shell body are provided as sheet metal shell bodies. Therefore, the wheel housing can be reduced in weight and thermal capacity. Further, due to the first shell body and the second shell body that are provided as sheet metal shell bodies, the peripheral wall is lower in strength in comparison with cast shell bodies. However, the peripheral wall is reinforced by the reinforcement portion, and hence can be restrained from being deformed.

In the turbocharger wheel housing according to each of the foregoing aspects of the invention, the shell body may include a connection portion that connects the scroll portion with an exhaust pipe or an intake pipe, the first shell body may include a first divisional connection portion as part of the connection portion, the second shell body may include a second divisional connection portion that forms part of the connection portion, and the connection portion may be composed of the first divisional connection portion and the second divisional connection portion that are combined with each other.

It is also conceived that the sheet metal shell body be structured with its connection portion undivided. In this case, however, when an opening portion for the gas passage is formed through the connection portion, a process of punching out part of a sheet metal is required. In the aforementioned wheel housing, the connection portion is composed of the first divisional connection portion and the second divisional connection portion that are combined with each other. Therefore, the process of punching out part of the sheet metal to form the connection portion is not required. Accordingly, the yield ratio of a material can be enhanced.

In the aforementioned turbocharger wheel housing, the first shell body may be formed of a metal plate having an oblong flat plate portion and a protrusion portion that protrudes from a long side of the flat plate portion, the reinforcement portion may be formed by working the flat plate portion into a cylindrical shape, and the first divisional connection portion may be obtained by working the protrusion portion into a circular shape.

It is also conceived that the first shell body be structured by forming the reinforcement portion and the first divisional connection portion separately from each other and joining them to each other through a joining operation such as welding or the like. In this case, however, the aforementioned joining operation is required in manufacturing the first shell body. In the invention, the first shell body is formed of the single metal plate having the oblong flat plate portion and the protrusion portion protruding from the long side of this flat plate portion. Therefore, the first shell body can be manufactured without having to include a joining operation such as welding or the like.

In the aforementioned turbocharger wheel housing, the base body may include a flange portion which protrudes radially outward beyond the accommodation portion, and the wheel housing may be formed by fitting one of the reinforcement portion of the first shell body and the scroll portion of the second shell body to an outer periphery of the flange portion of the base body and fitting the other of the reinforcement portion and the scroll portion to an inner periphery of the one of the reinforcement portion and the scroll portion that is fitted to the outer periphery of the flange.

According to this wheel housing, the reinforcement portion of the first shell body is fitted to the outer periphery of the flange portion of the base body, and the scroll portion of the second shell body is fitted to the inner periphery of the reinforcement portion. Alternatively, the scroll portion of the second shell body is fitted to the outer periphery of the flange portion of the base body, and the reinforcement portion of the first shell body is fitted to the inner periphery of the scroll portion of the second shell body. In either case, the aforementioned respective structural bodies are fitted to each other to remain combined with each other. Accordingly, a jig for combining the aforementioned respective structural bodies with each other can be dispensed with or simplified in construction.

In the wheel housing, the pillar portion may be longer in a circumferential direction than the slit portion.

A turbocharger turbine housing may be constructed in the same manner as the aforementioned wheel housing.

According to this turbine housing, the amount of deformation of the second shell body of the turbine housing can be made small, and the operability in superposing the reinforcement portion on the inner peripheral face or the outer peripheral face of the peripheral wall of the scroll portion can be made good.

A turbocharger compressor housing may be constructed in the same manner as the aforementioned wheel housing.

According to this compressor housing, the amount of deformation of the second shell body of the compressor housing can be made small, and the operability in superposing the reinforcement portion on the inner peripheral face or the outer peripheral face of the peripheral wall of the scroll portion can be made good.

A turbocharger may include the aforementioned wheel housing.

BRIEF DESCRIPTION OF THE DRAWINGS

The foregoing and further features and advantages of the invention will become apparent from the following description of example embodiments of the invention with reference to the accompanying drawings, wherein like numerals are used to represent like elements and wherein.

DETAILED DESCRIPTION OF THE EMBODIMENTS

First Embodiment

The first embodiment of the invention will be described with reference to FIGS. 1 to 7. It should be noted that this embodiment of the invention shows an example in which the invention is embodied as a turbocharger turbine housing for an internal combustion engine.

Figure 1:
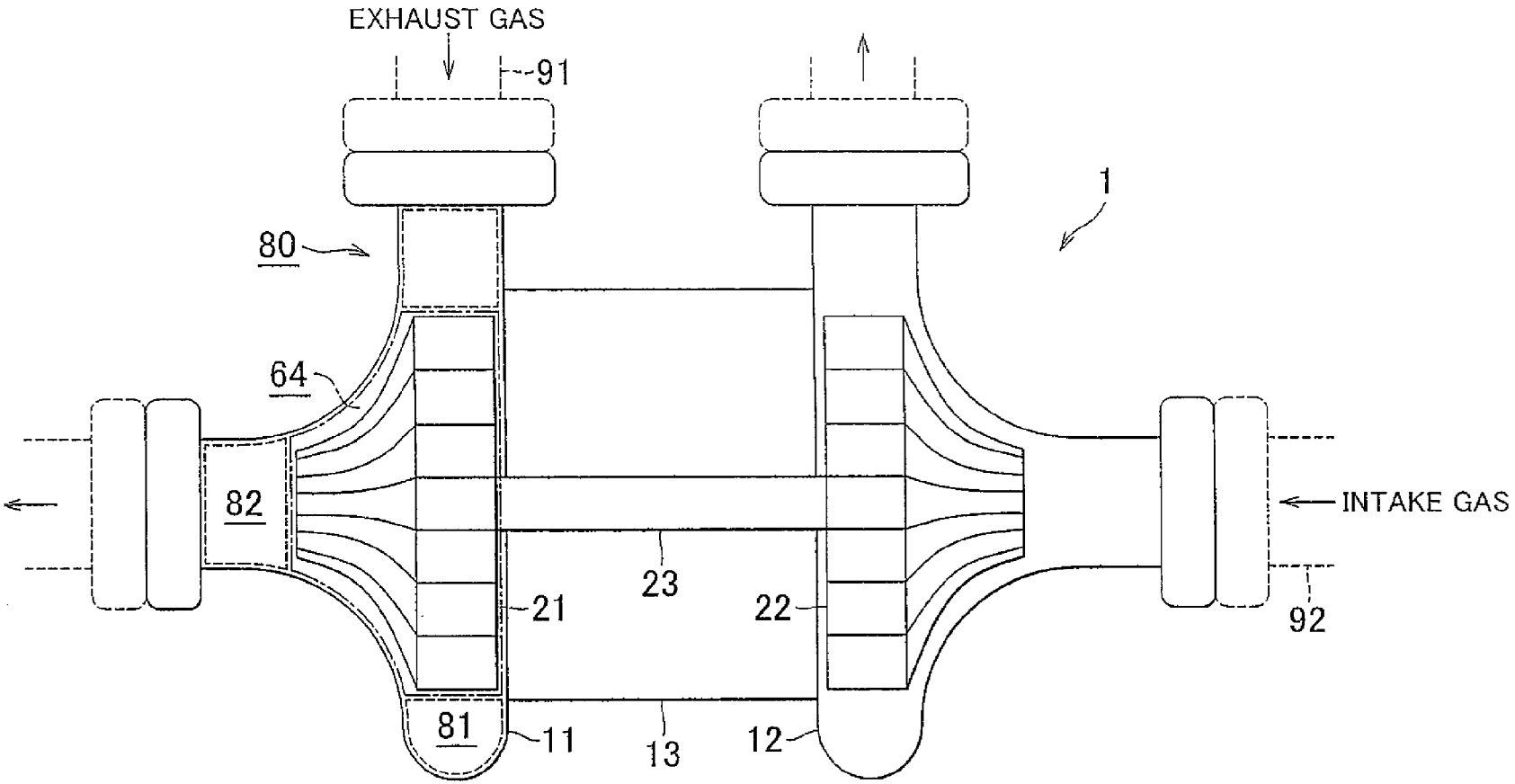
FIG. 1 is a schematic view schematically showing a structure of an entire turbocharger as to one embodiment realized by embodying a turbocharger of the invention.

As shown in FIG. 1, a turbocharger 1 is provided with a turbine wheel 21 that rotates with the aid of the energy of exhaust gas, a compressor wheel 22 that compresses intake air as the wheel 21 rotates, a rotor shaft 23 that connects these wheels to each other, a turbine housing 11 that accommodates the turbine wheel 21, a compressor housing 12 that accommodates the compressor wheel 22, and a center housing 13 that accommodates the rotor shaft 23. An exhaust pipe 91 and an intake pipe 92 are connected to the turbine housing 11 and the compressor housing 12 respectively.

In the turbocharger 1, the turbine wheel 21 and the compressor wheel 22 are connected to the rotor shaft 23 respectively. Therefore, these three elements rotate integrally. Further, the turbine housing 11 and the compressor housing 12 are connected to the center housing 13.

In the turbine housing 11, a wheel chamber 64 in which the turbine wheel 21 is accommodated, and an exhaust passage 80 for causing an exhaust gas from an exhaust pipe 91 upstream of the turbine housing 11 to flow to the exhaust pipe 91 downstream of the turbine housing 11 are formed. The exhaust passage 80 is formed of the wheel chamber 64 in which the turbine wheel 21 is accommodated, and a scroll passage 81 for supplying the exhaust gas from the upstream exhaust pipe 91 to the wheel chamber 64, and an outlet passage for delivering the exhaust gas from the turbine wheel 21 to the downstream exhaust pipe 91.

Figure 2:
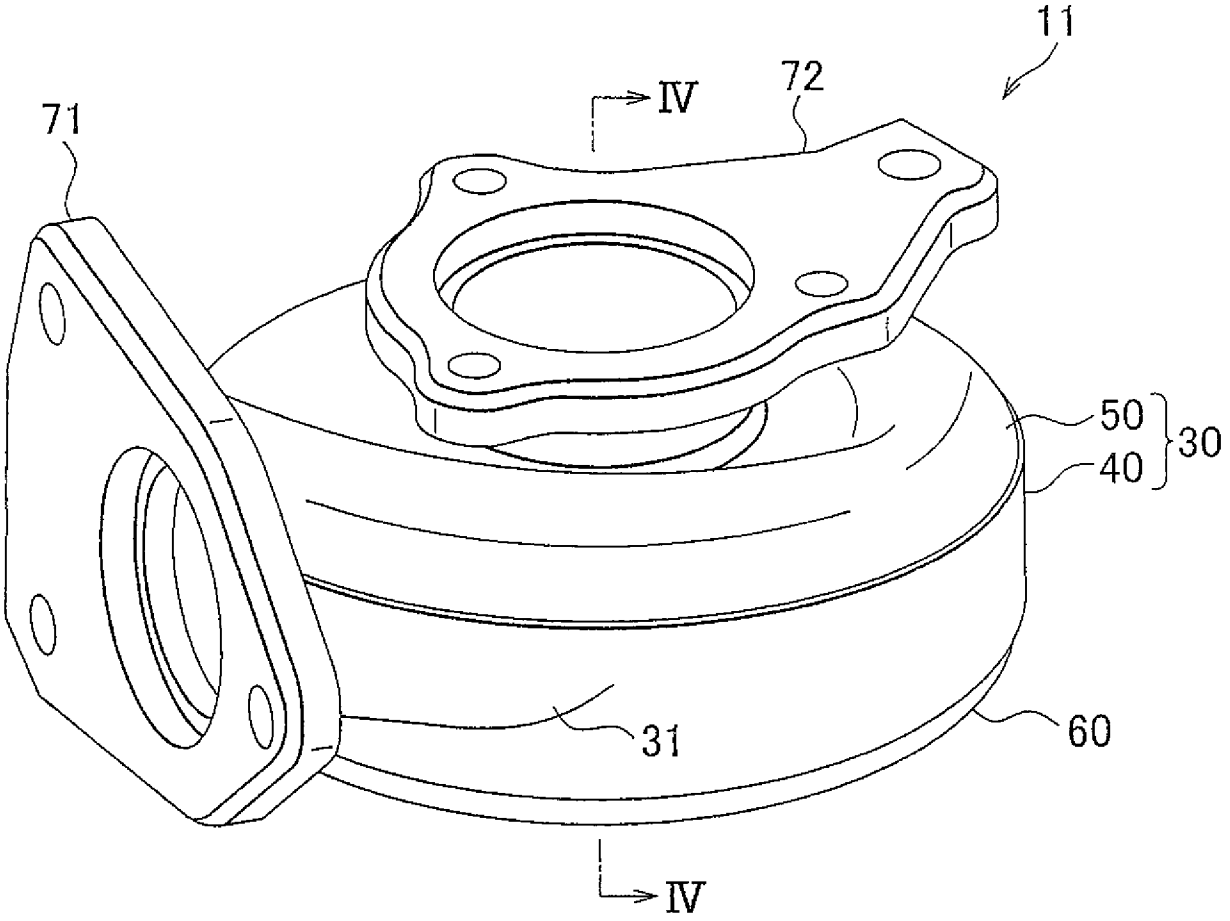
FIG. 2 is a perspective view showing a perspective structure of a turbine housing according to the embodiment of the invention.

The structure of the turbine housing 11 will be described with reference to FIGS. 2 to 4. As shown in FIG. 2, the turbine housing 11 is configured to include a shell body 30 and a base body 60 that are combined with each other to form the exhaust passage 80, an inlet flange 71 connected to the exhaust pipe 91 upstream of the turbine housing 11 via a connection portion 31, and an outlet flange 72 to which the exhaust pipe 91 downstream of the turbine housing 11 is connected.

The shell body 30 is composed of a first shell body 40 and a second shell body 50. The first shell body 40 and the second shell body 50 are obtained by press-molding sheet metals. The base body 60, the inlet flange 71, and the outlet flange 72 are cast.

Figure 3:
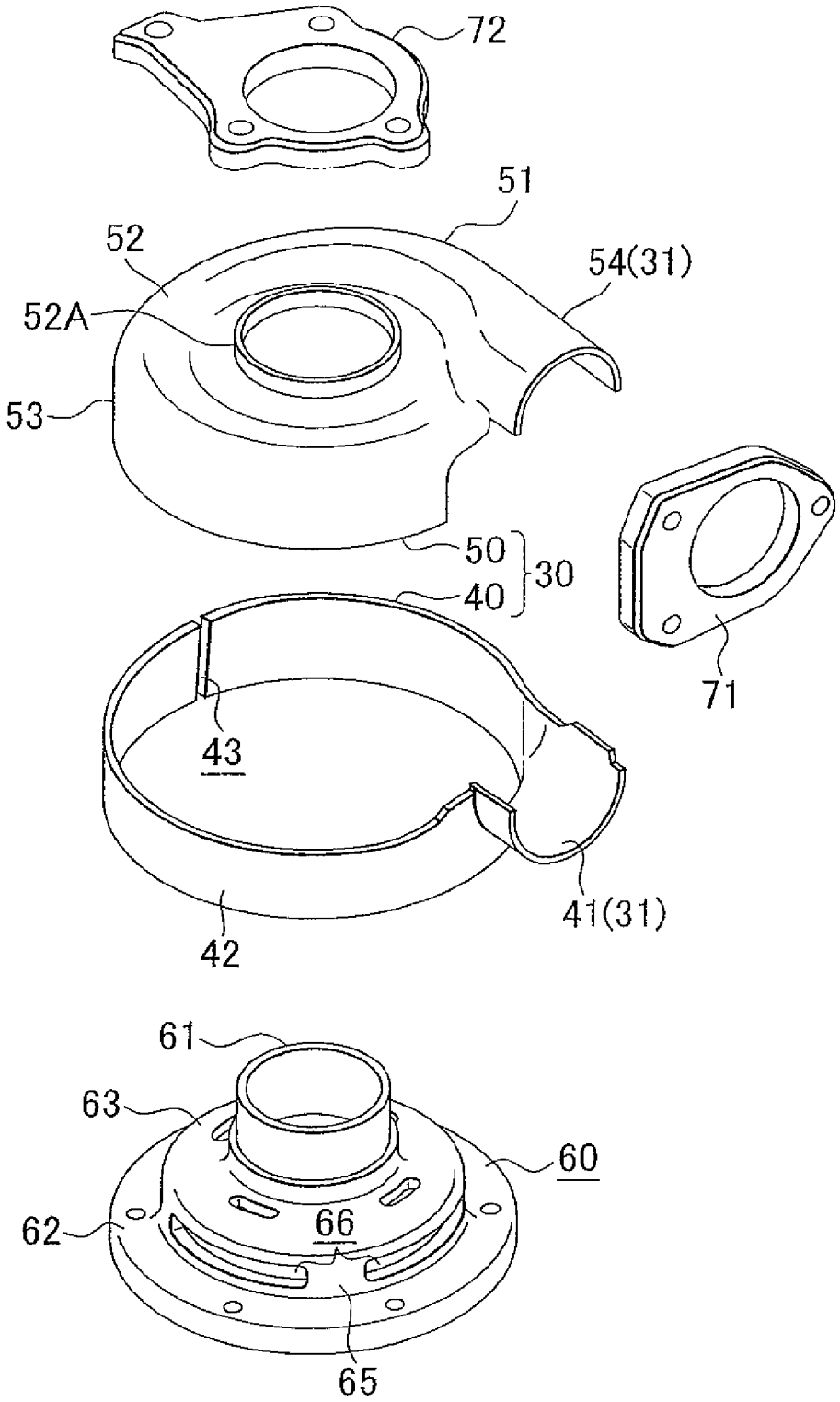
FIG. 3 is a perspective view showing an exploded perspective structure of the turbine housing according to the embodiment of the invention.

As shown in FIG. 3, the second shell body 50 is configured to include a disk-like scroll portion 51, and a second divisional connection portion 54 constituting part of the connection portion 31. The scroll portion 51 is provided with a lateral wall portion 53 extending in a circumferential direction, and a top wall portion 52 extending in a radial direction.

The first shell body 40 is configured to include a first divisional connection portion 41 constituting part of the connection portion 31, and a cylindrical reinforcement portion 42 elongated from the connection portion 41 in the circumferential direction to extend along an outer periphery of the lateral wall portion 53 of the second shell body 50. A slit portion 43 that is partially discontinuous in the circumferential direction is formed through the reinforcement portion 42. That is, the reinforcement portion 42 is constructed as a cylindrical element having a region that is discontinuous in the circumferential direction.

The base body 60 is provided with a circular flange portion 62 for connecting the center housing 13 (see FIG. 1) and the turbine housing 11 to each other, a cylinder portion 61 to which a joint portion 52A of the second shell body 50 and the outlet flange 72 are fitted, and an accommodation portion 63 in which the turbine wheel 21 is accommodated. The accommodation portion 63 is provided in such a manner as to connect the cylinder portion 61 and the flange portion 62 to each other. The accommodation portion 63 is provided with communication portions 66 through which the scroll passage 81 and the wheel chamber. 64 communicate with each other. Each of pillar portions 65 is provided between corresponding adjacent ones of the communication portions 66 in such a manner as to connect the flange portion 62 and the cylinder portion 61 to each other.

The longitudinal cross-sectional structure of the turbine housing 11 will be described with reference to FIG. 4. It should be noted that FIG. 4 shows a cross-sectional structure of the turbine housing 11 along a line IV-IV of FIG. 2. Further, alternate long and short dash lines P in FIG. 4 indicate centerlines of the turbine housing 11 and the turbine wheel 21.

The respective elements of the turbine housing 11 are combined with one another as will be described below. The outlet flange 72 is fitted to the outside of a tip end portion 61C of the cylinder portion 61 of the base body 60. An outer peripheral face 61A of the tip end portion 61C and an inner peripheral face 72A of the outlet flange 72 are joined to each other through brazing.

A joint portion 52A of the second shell body 50 is fitted to the outside of a base end portion 61B of the cylinder portion 61 of the base body 60. An outer peripheral face 61A of the base end portion 61B and an inner peripheral face 52B of the joint portion 52A are joined to each other through brazing.

The inner peripheral face 52B of the top wall portion 52 of the second shell body 50 is butted against a top face 63A of the accommodation portion 63 of the base body 60 in the vicinity of the cylinder portion 61. The top face 63A in the vicinity of the cylinder portion 61 and the inner peripheral face 52B of the top wall portion 52 are in contact with each other with no gap formed therebetween.

A lower end face 53B of the lateral wall portion 53 of the second shell body 50 is butted against a top face 62A of the flange portion 62 of the base body 60. The top face 62A of the flange portion 62 and the lower end face 53B of the lateral wall portion 53 are joined to each other through brazing.

A lower end portion 42B of the reinforcement portion 42 of the first shell body 40 is fitted to the outside of the flange portion 62 of the base body 60 and the outside of the lateral wall portion 53 of the second shell body 50. The outer peripheral face 62B of the flange portion 62 and the outer peripheral face 53A of the lateral wall portion 53 are joined to the inner peripheral face 42A of the lower end portion 42B of the reinforcement portion 42 through brazing.

A passage for exhaust gas is formed in the turbine housing 11 as will be described below. The scroll passage 81 is formed between the scroll portion 51 on the one hand and the accommodation portion 63 and the flange portion 62 on the other hand. Further, an outlet passage 82 is formed in the cylinder portion 61. The scroll passage 81 communicates with an inlet of the wheel chamber 64 via the communication portions 66. The outlet passage 82 communicates with an outlet of the wheel chamber 64.

The lateral cross-sectional structure of the turbine housing 11 will be described with reference to FIGS. 5A and 5B. It should be noted that FIG. 5A shows a cross-sectional structure of the turbine housing 11 along a line V-V of FIG. 4. Further, a point P in FIG. 5A indicates centerlines of the turbine housing 11 and the turbine wheel 21. Further, an arrow RA in FIG. 5A indicates a direction of rotation of the turbine wheel 21.

As shown in FIG. 5A, the first divisional connection portion 41 of the first shell body 40 is fitted to the outside of the second divisional connection portion 54 of the second shell body 50. An outer peripheral face 54A of the second divisional connection portion 54 and an inner peripheral face 41B of the first divisional connection portion 41 are connected to each other through brazing.

The inlet flange 71 is fitted to the outside of the first divisional connection portion 41 of the first shell body 40. An outer peripheral face 41A of the connection portion 41 and an inner peripheral face 71A of the inlet flange 71 are joined to each other through brazing.

Figure 4:
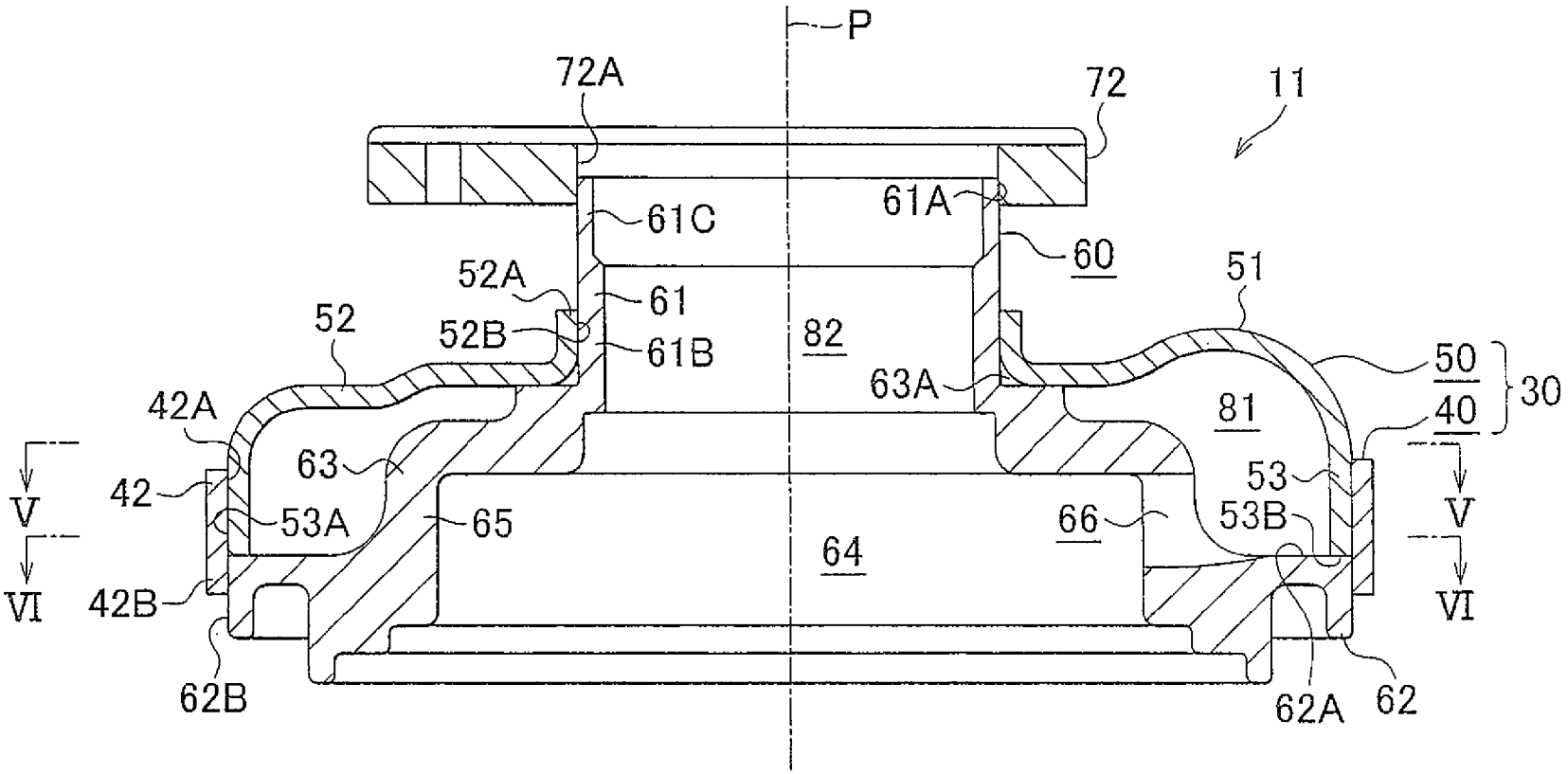
FIG. 4 is a cross-sectional view showing a cross-sectional structure of the turbine housing according to the embodiment of the invention along a line IV-IV of FIG. 2.
Figure 5A:
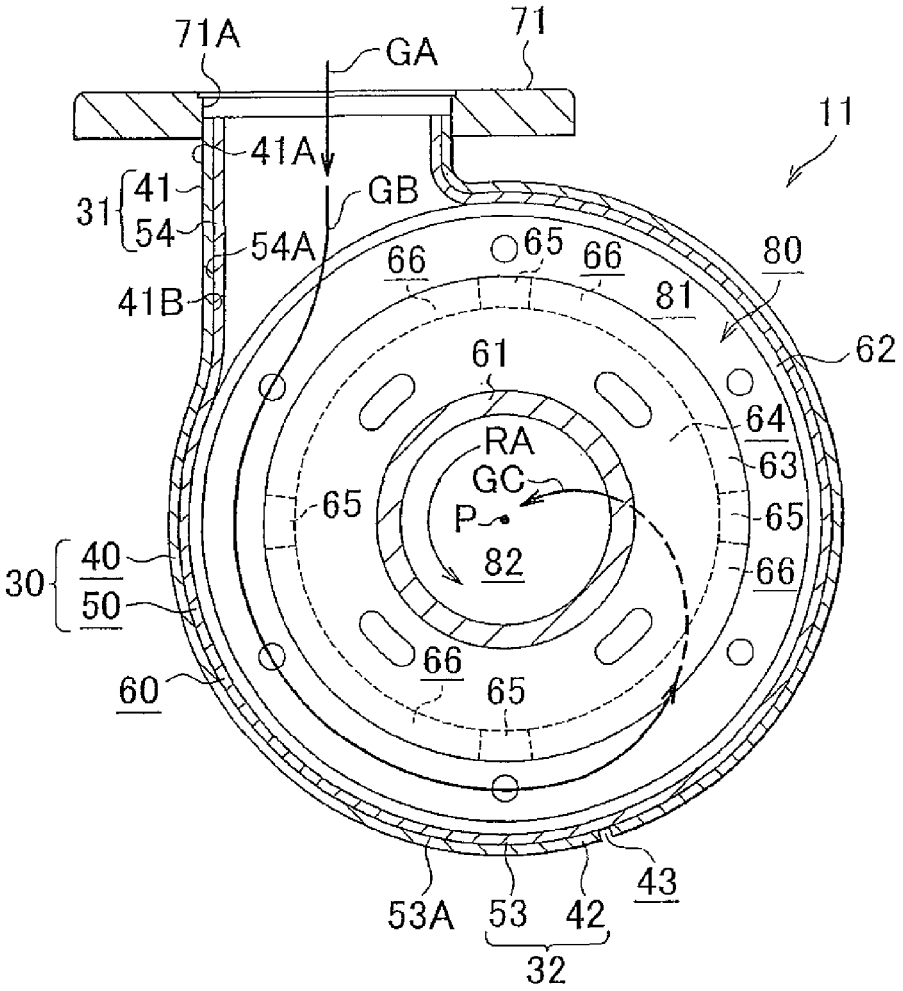
FIG. 5A is a cross-sectional view showing a cross-sectional structure of the turbine housing according to the embodiment of the invention along a line V-V of FIG. 4.

Although not shown, the inlet flange 71 is fitted to the outside of the second divisional connection portion 54 of the second shell body 50 on a cross-section extending parallel to a cross-section of FIG. 4 and located more downstream of the outlet passage 82 than the cross-section. The outer peripheral face 54A of the connection portion 54 and the inner peripheral face 71A of the inlet flange 71 are joined to each other through brazing. That is, the inlet flange 71 is fitted to the outer peripheral face of the connection portion 31, which is composed of the second divisional connection portion 54 and the first divisional connection portion 41, and the outer peripheral face of the connection portion 31 and the inner peripheral face 71A of the inlet flange 71 are joined to each other through brazing.

The reinforcement portion 42 of the first shell body 40 is entirely superposed on the outer peripheral face 53A of the lateral wall portion 53 of the second shell body 50 in the circumferential direction. The lateral wall portion 32 of the shell body 30 is constituted by a region where the reinforcement portion 42 and the lateral wall portion 53 are superposed on each other.

Figure 5B:
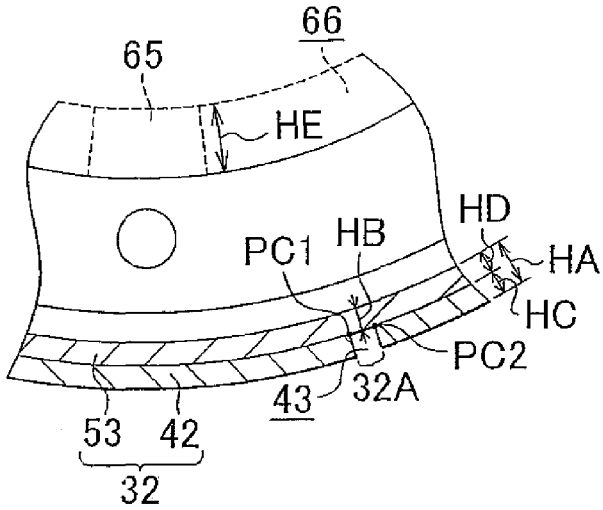
FIG. 5B is an enlarged view showing part of FIG. 5A on an enlarged scale.

As shown in FIG. 5B, the lateral wall portion 32 has a thickness HA that is set substantially equal from one end to the other end of the connection portion 31 in the circumferential direction of the shell body 30. However, that region of the lateral wall portion 32 where the slit portion 43 and the lateral wall portion 53 are superposed on each other (hereinafter referred to as a thin-walled portion 32A) has a thickness HB smaller than that of the other region of the lateral wall portion 32.

The thicknesses of the respective regions are related to one another as will be described below. The reinforcement portion 42 has a thickness HC that is set substantially equal to a thickness HD of the lateral wall portion 53. The thickness HA of the lateral wall portion 32 except the thin-walled portion 32A is equal to the sum of the thickness HC of the reinforcement portion 42 and the thickness HD of the lateral wall portion 53. The thickness HB of the thin-walled portion 32A is equal to the thickness HD of the lateral wall portion 53.

The pillar portions 65 have a thickness HE that is set larger than the thickness HC of the reinforcement portion 42 and the thickness HD of the lateral wall portion 53 respectively. Further, the thickness HE of the pillar portions 65 is set larger than the thickness HA of the lateral wall portion 32 except the thin-walled portion 32A.

Exhaust gas flows in the turbine housing 11 as will be described below. As indicated by an arrow GA of FIG. 5A, the exhaust gas in the exhaust pipe 91 upstream of the turbine housing 11 flows into the turbine housing 11 via an inlet of the scroll passage 81 constituted by the connection portion 31. As indicated by an arrow GB, the exhaust gas that has flowed into the inlet of the scroll passage 81 flows around the accommodation portion 63 in the circumferential direction in the passage 81, and flows into the wheel chamber 64 via the communication portions 66 in this process. As indicated by an arrow GC, the exhaust gas that has flowed into the wheel chamber 64 hits a blade of the turbine wheel 21, and then is delivered to the outlet passage 82 as the wheel 21 rotates. The exhaust gas that has been delivered to the outlet passage 82 flows into the exhaust pipe 91 downstream of the turbine housing 11 through the passage 82.

Figure 6:
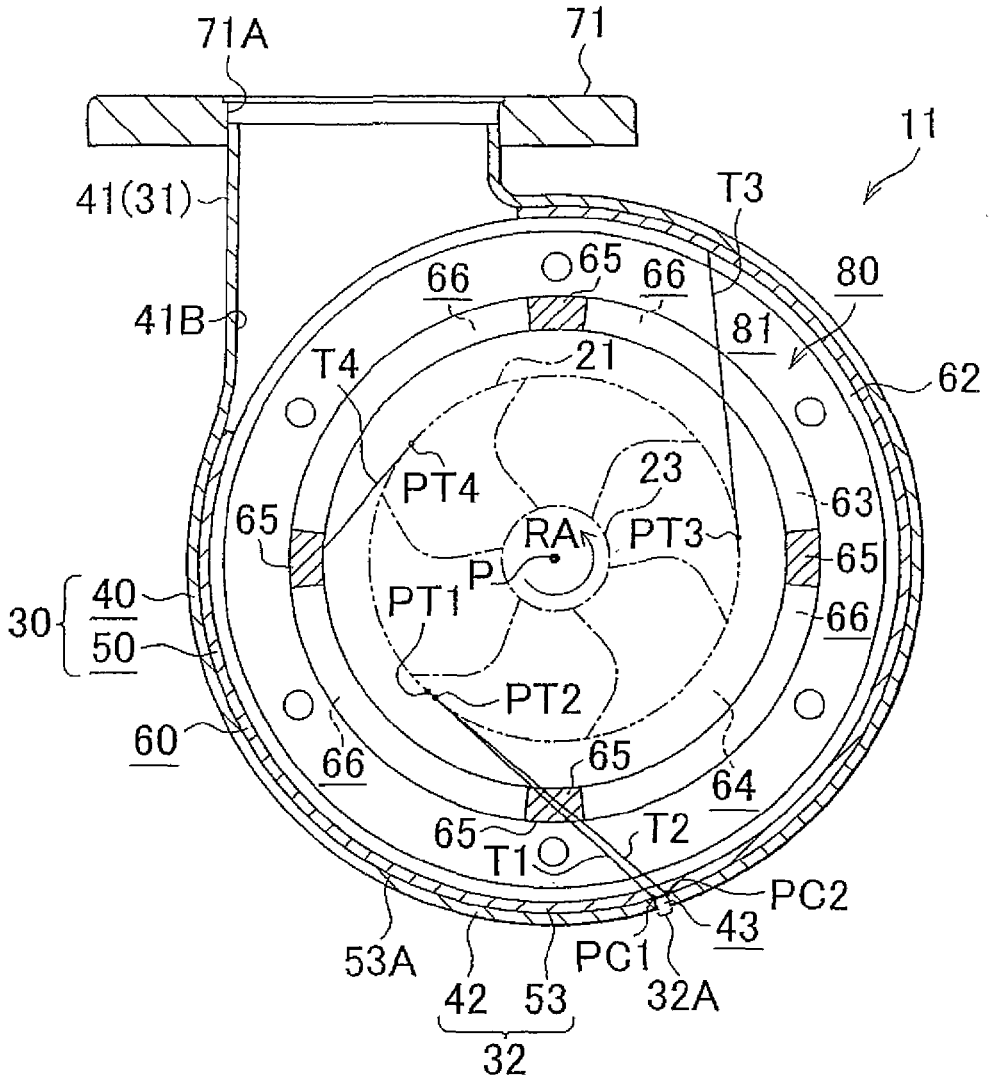
FIG. 6 is a cross-sectional view showing a cross-sectional structure of the turbine housing according to the embodiment of the invention along a line VI-VI of FIG. 4.

The more detailed structure of the turbine housing 11, mainly the constructions of the pillar portions 65 of the base body 60, the reinforcement portion 42 of the first shell body 40, and the lateral wall portion 53 of the second shell body 50 will be described in detail with reference to FIG. 6. It should be noted that FIG. 6 shows a cross-sectional structure of the turbine housing 11 along a line VI-VI of FIG. 4. Further, an arrow RA in FIG. 6 indicates a direction of rotation of the turbine wheel 21.

The base body 60 is provided with the four pillar portions 65 arranged at angular intervals of 90° in the circumferential direction. Each of the communication portions 66 is formed between corresponding ones of the pillar portions 65 that are adjacent to each other in the circumferential direction. The communication portions 66 have a circumferential length that is set longer than a circumferential length of the pillar portions 65. The circumferential length of the pillar portions 65 is set longer than the circumferential length of the slit portion 43.

Circumferential rotational phases of the shell body 30 and the base body 60 are set on the basis of a concept that will be described below. That is, the thin-walled portion 32A of the lateral wall portion 32 of the shell body 30 is smaller in thickness than the other region of the lateral wall portion 32, and hence is likely to be deformed excessively when a fragment of the blade of the turbine wheel 21 hits the thin-walled portion 32A.

Thus, in this turbine housing 11, the pillars 65 are provided on a traveling path of the fragment of the turbine wheel 21 moving from a main body of the turbine wheel 21 toward the thin-walled portion 32A. That is, the circumferential phases of the shell body 30 and the base body 60 are set such that that one of fragments flying from the main body of the turbine wheel 21 in all directions which may hit the thin-walled portion 32A of the shell body 30 is received by a region higher in strength than the thin-walled portion 32A before the fragment reaches the thin-walled portion 32A.

A mode of setting these phases can be described as follows. It should be noted herein that that one of tangential lines of the turbine wheel 21 which passes one end of the thin-walled portion 32A, namely, which passes a tangent point PT1 on an outer periphery of the turbine wheel 21 and a point PC1 at an end of the thin-walled portion 32A is defined as a tangential line T1. Further, that one of the tangential lines of the turbine wheel 21 which passes the other end of the thin-walled portion 32A, namely, which passes a tangent point PT2 on the outer periphery of the turbine wheel 21 and a point PC2 at an end of the thin-walled portion 32A is defined as a tangential line T2. In the turbine housing 11, the circumferential phases of the shell body 30 and the base body 60 are set such that each of the pillar portions 65 is located between these tangential lines T1 and T2.

Accordingly, when a fragment separates from the main body of the turbine wheel 21, the frequency with which this fragment hits the pillar portion 65 located between the turbine wheel 21 and the thin-walled portion 32A is high. Thus, the shell body 30 is restrained from being excessively deformed due to the hitting of the fragment.

Patterns of the traveling path of the fragment that has separated from the turbine wheel 21 will be exemplified below. When it is assumed that the fragment has flown out from the tangent points PT1 and PT2, this fragment moves on the tangential lines T1 and T2, and hits a corresponding one of the pillar portions 65 before reaching the thin-walled portion 32A of the shell body 30.

When it is assumed that a fragment has flown out from a tangent point PT3, this fragment moves on a tangential line T3 whose tangent point coincides with the tangent point PT3, and hits that region of the lateral wall portion 32 of the shell body 30 which is formed by the reinforcement portion 42 and the lateral wall portion 53.

When it is assumed that a fragment has flown out from a tangent point PT4, this fragment moves on a tangential line T4 whose tangent point coincides with the tangent point PT4, and hits a corresponding one of the pillar portions 65 of the base body 60 before reaching the lateral wall portion 32 of the shell body 30.

Figure 7A:
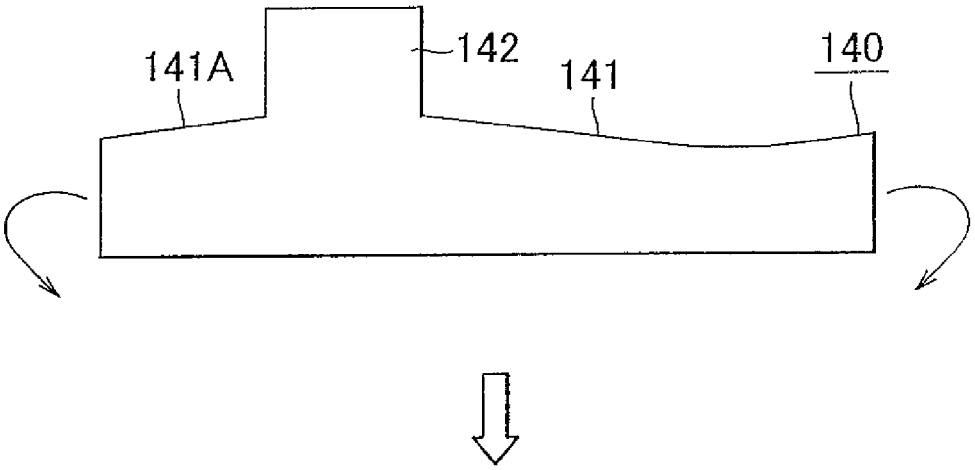
FIGS. 7A and 7B are process views showing a mode of operation in manufacturing a first shell body of the turbine housing according to the embodiment of the invention.

A process of manufacturing the first shell body 40 will be described with reference to FIGS. 7A and 7B. As shown in FIG. 7A, a metal plate 140 having an oblong flat plate portion 141 and a protrusion portion 142 protruding from a long side 141A of this flat plate portion 141 is formed.

Figure 7B:
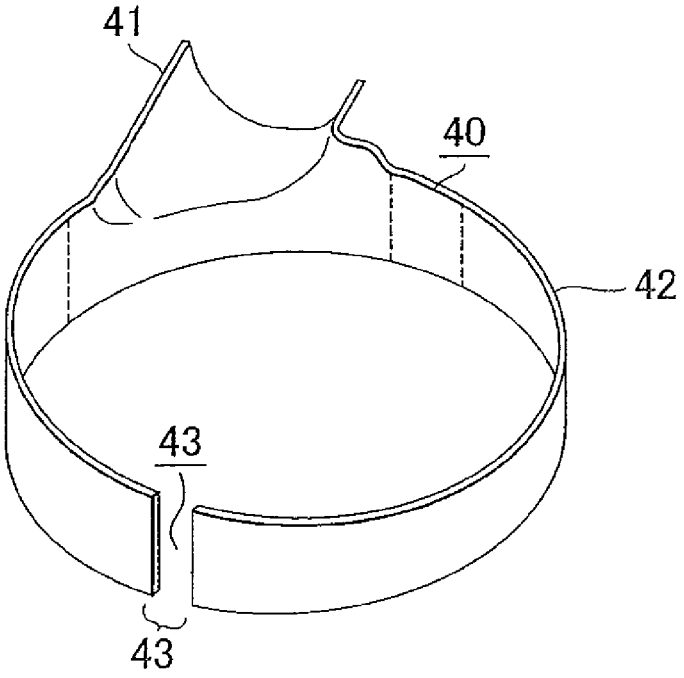

As shown in FIG. 7B, the flat plate portion 141 of the metal plate 140 is bent into a cylindrical shape, and the reinforcement portion 42 having the slit portion 43 is formed. Further, the protrusion portion 142 is press-molded into the shape of the first divisional connection portion 41. Thus, the first shell body 40 is formed.

A process of assembling the shell body 30 and the base body 60 will be described. (Step A) The reinforcement portion 42 of the first shell body 40 is fitted to the outside of the flange portion 62 of the base body 60. At this moment, the circumferential phases of the base body 60 and the first shell body 40 are adjusted such that the pillar portions 65 of the base body 60 are so located as to correspond to the tangential lines T1 and T2. (Step B) The lateral wall portion 53 of the second shell body 50 is fitted to the inside of the reinforcement portion 42 of the first shell body 40, and the lower end face 53B of the second shell body 50 is butted against the top face 62A of the flange portion 62 of the base body 60. (Step C) A brazing solder is arranged on respective joint portions of the first shell body 40, the second shell body 50, and the base body 60. (Step D) The first shell body 40, the second shell body 50, and the base body 60 are put into a kilt and heated. At this moment, the brazing solder melts and flows into gaps among the respective joint portions, and the first shell body 40, the second shell body 50, and the base body 60 are joined to one another. (Step E) The inlet flange 71 is fitted to the outside of the connection portion 31 of the shell body 30, and the outlet flange 72 is fitted to the outside of the cylinder portion 61 of the base body 60. (Step F) A brazing solder is arranged on a joint portion between the connection portion 31 of the shell body 30 and the inlet flange 71, and on a joint portion between the base body 60 and the outlet flange 72. (Step G) The shell body 30, the base body 60, the inlet flange 71, and the outlet flange 72 are put into a kilt and heated. At this moment, the brazing solder melts and flows into gaps among the respective joint portions, and the shell body 30, the base body 60, the inlet flange 71, and the outlet flange 72 are thereby joined to one another.

As described above in detail, according to this embodiment of the invention, the following effects are achieved. (1) In this embodiment of the invention, the first shell body 40 is so provided as to include the reinforcement portion 42 superposed on the outer peripheral face 53A of the lateral wall portion 53 of the scroll portion 51. Further, the reinforcement portion 42 is so provided as to have the slit portion 43 that is partially discontinuous in the circumferential direction. Further, the shell body 30 and the base body 60 are combined with each other such that the pillar portions 65 are so located as to intersect with those of the tangential lines T1 and T2 of the turbine wheel 21 which pass the points PC1 and PC2 at the end of the thin-walled portion 32A, namely, such that the pillar portions 65 are located on the traveling path of a fragment of the wheel 21 moving from the main body of the wheel 21 toward the thin-walled portion 32A.

Thus, the amount of deformation of the second shell body 50 can be made small when the fragment of the wheel 21 hits the lateral wall portion 53 of the scroll portion 51. On the other hand, it is also conceivable that the reinforcement portion 42 be structured not to include the slit portion 43. In the case of such a structure, the operation of superposing the reinforcement portion 42 on the lateral wall portion 53 of the scroll portion 51 is troublesome in manufacturing the shell body 50. In this embodiment of the invention, the reinforcement portion 42 is provided with the slit portion 43. Therefore, the operability in superposing the reinforcement portion 42 on the outer peripheral face 53A of the lateral wall portion 53 of the scroll portion 51 can be made good.

(2) The first shell body 40 and the second shell body 50 according to this embodiment of the invention are provided as sheet metal shell bodies. Therefore, the turbine housing 11 can be reduced in weight and thermal capacity, further, the first shell body 40 and the second shell body 50 are sheet metal shell bodies, and hence the lateral wall portion 53 is lower in strength in comparison with the case of cast shell bodies. However, the lateral wall portion 53 is reinforced by the reinforcement portion 42 and thus can be restrained from being deformed. Further, since the first shell body 40 and the second shell body 50 are employed for the turbine housing 11, the thermal energy of exhaust gas can be restrained from decreasing.

(3) It is also conceivable that the sheet metal shell body 30 be structured with the connection portion 31 undivided. In this case, however, a process of punching out part of the sheet metal is required in forming an opening portion for the exhaust passage 80 through the connection portion 31. In this embodiment of the invention, the connection portion 31 of the shell body is constructed by combining the first divisional connection portion 41 of the first shell body 40 and the second divisional connection portion 54 of the second shell body 50 with each other. Thus, the process of punching out part of the sheet metal to form the connection portion 31 is not required. Accordingly, the yield ratio of a material can be enhanced.

(4) It is also conceivable that the first shell body 40 be structured by forming the reinforcement portion 42 and the first divisional connection portion 41 separately from each other and joining them to each other through a joining operation such as welding or the like. In this case, however, the aforementioned joining operation is required in manufacturing the first shell body 40. In this embodiment of the invention, the metal plate 140 having the oblong flat plate portion 141 and the protrusion portion 142 protruding from the long side of this flat plate portion 141 is used as a material for the first shell body 40. The flat plate portion 141 of this metal plate 140 is then worked into a cylindrical shape to form the reinforcement portion 42, and the first shell body 40 is manufactured through a step of working the protrusion portion 142 into a circular shape to form the first divisional connection portion 41. Thus, the first shell body 40 can be, manufactured without the need to include a joining operation such as welding or the like. Further, since the first shell body 40 is obtained through simple working, the yield ratio can be enhanced.

(5) In this embodiment of the invention, the turbine housing 11 is structured such that it can be assembled by fitting the reinforcement portion 42 of the first shell body 40 to the outer periphery of the flange portion 62 of the base body 60 and fitting the lateral wall portion 53 of the second shell body 50 to the inner periphery of the reinforcement portion 42. Thus, the first shell body 40, the second shell body 50, and the base body 60 remain combined with one another. Accordingly, a jig for combining the first shell body 40, the second shell body 50, and the base body 60 with one another can be dispensed with or simplified in construction.

Other Embodiments

It should be noted that the mode of implementing the invention is not limited to the foregoing embodiment of the invention. For example, the invention can also be implemented in modes that will be described below. Further, the following respective modification examples are applied not only to the foregoing embodiment of the invention, but it is also possible to combine the different modification examples with one another to implement them.

In the foregoing embodiment of the invention, the lateral wall portion 53 of the second shell body 50 is fitted to the inside of the reinforcement portion 42 of the first shell body 40. However, it is also possible to fit the reinforcement portion 42 of the first shell body 40 to the inside of the lateral wall portion 53 of the second shell body 50.

In the foregoing embodiment of the invention, the first shell body 40 is structured with the first divisional connection portion 41 and the reinforcement portion 42 made of the same material and formed integrally with each other. However, the structure of the shell body 40 can also be changed as will be described below. That is, the first shell body 40 can also be constructed by forming the first divisional connection portion 41 and the reinforcement portion 42 separately from each other and joining these components to each other through welding or the like. Further, instead of the first divisional connection portion 41, the region corresponding to the connection portion 31 can also be made of the same material as the reinforcement portion 42 and formed integrally therewith to constitute the first shell body 40.

In the foregoing embodiment of the invention, the second shell body 50 is structured with the second divisional connection portion 54 and the scroll portion 51 made of the same material and formed integrally with each other. However, the structure of the shell body 50 can also be changed as will be described below. That is, the second shell body 50 can also be constructed by forming the second divisional connection portion 54 and the scroll portion 51 separately from each other and joining these components to each other through welding or the like. Further, instead of the second divisional connection portion 54, the region corresponding to the connection portion 31 can also be made of the same material as the scroll portion 51 and formed integrally therewith to constitute the second shell body 50.

In the foregoing embodiment of the invention, the first divisional connection portion 41 and the second divisional connection portion 54, which constitute the connection portion 31, are constructed as part of the first shell body 40 and part of the second shell body 50 respectively. However, the connection portion 31 can also be formed separately from the respective shell bodies. In this case, the first divisional connection portion 41 and the second divisional connection portion 54 can be formed separately from the respective shells and joined to each other to constitute the connection portion 31. Alternatively, the connection portion 31 with the first divisional connection portion 41 and the second divisional connection portion 54 formed separately from the respective shell bodies and joined to each other can also be formed as a single element serving as the connection portion 31.

In the foregoing embodiment of the invention, the slit portion 43 is formed in such a shape that one end face and the other end face of the reinforcement portion 42 extend parallel to each other. However, the slit portion 43 is not limited to this shape. For example, the slit portion 43 can also be formed in such a shape that the clearance between one end face and the other end face of the reinforcement portion 42 gradually increases from one end to the other end in the width direction of the reinforcement portion 42.

In the foregoing embodiment of the invention, the base body 60 is structured to include the four pillar portions 65 and the four communication portions 66. However, the number of the pillar portions 65 or the communication portions 66 can be changed to an integer between 1 and 3 or an integer equal to or larger than 5.

In the foregoing embodiment of the invention, as a structure for preventing the fragment of the turbine wheel 21 from hitting the thin-walled portion 32A, the pillar portions 65 are provided inside those of the tangential lines T1 and T2 of the turbine wheel 21 which pass both the end points of the slit portion 43 respectively. However, the concrete contents of the aforementioned structure are not limited as described above. For example, the pillar portions 65 can also be positioned such that only one of the tangential lines T1 and T2 passes the pillar portions 65. Further, in the foregoing embodiment of the invention, on the premise of the pillar portions 65 and the slit portion 43 that are dimensioned as shown in FIGS. 5A and 5B, the aforementioned structure for making it possible to prevent the fragment of the turbine wheel 21 from hitting the thin-walled portion 32A is adopted. However, even in, the case where the pillar portions 65 and the slit portion 43 are different in size from those exemplified in the foregoing embodiment of the invention, an effect similar to the embodiment of the invention can be achieved by setting the circumferential phases of the shell body 30 and the base body 60 on the basis of the same concept as the embodiment of the invention. In short, as long as there is a structure in which the pillar portions 65 are provided on the traveling path of the fragment separating from the main body of the turbine wheel 21 and moving toward the thin-walled portion 32A, the positional relationship between the pillar portions 65 and the slit portion 43, and the sizes and shapes of these elements can be appropriately changed.

In each of the foregoing embodiments of the invention, the turbine housing 11 is constructed with the first shell body 40, the second shell body 50, the base body 60, the inlet flange 71, and the outlet flange 72 formed separately from one another and joined to one another. However, the turbine housing 11 is not limited to this construction. For example, at least one of the aforementioned respective structural bodies formed separately from one another can also be formed as a plurality of further divided structural bodies. Further, at least two of the aforementioned respective structural bodies except the first shell body 40 and the second shell body 50 can also be formed as a single structural body.

In each of the foregoing embodiments of the invention, the sheet metal shell bodies are adopted as the first shell body 40 and the second shell body 50. However, the first shell body 40 and the second shell body 50 can also be replaced with cast or resinous shell bodies.

In each of the foregoing embodiments of the invention, the cast base body is adopted as the base body 60. However, the base body 60 can also be replaced with a cast or resinous base body. In each of the foregoing embodiments of the invention, the invention is applied only to the former of the turbine housing 11 and the compressor housing 12. However, the invention can also be applied to the respective housings. Further, the invention can also be applied only to the compressor housing 12.

While the invention has been described with reference to the example embodiments thereof, it is to be understood that the invention is not limited to the described embodiments or constructions. To the contrary, the invention is intended to cover various modifications and equivalent arrangements. In addition, while the various elements of the disclosed invention are shown in various example combinations and configurations, other combinations and configurations, including more, less or only a single element, are also within the scope of the appended claims.

The invention claimed is:

1. A turbocharger wheel housing comprising:

a shell body having a scroll portion and a base body having an accommodation portion in which a wheel is accommodated, wherein a gas passage formed between the shell body and the base body, wherein:

the shell body is composed of a first shell body and a second shell body that are formed separately from each other and combined with each other;

the second shell body includes the scroll portion;

the accommodation portion includes a wheel chamber in which the wheel is arranged, a communication portion that allows a gas to flow from the gas passage to the wheel chamber, and a pillar portion provided adjacent to the communication portion to block flow of the gas from the gas passage to the wheel chamber;

the first shell body includes a reinforcement portion superposed on one of an inner peripheral face or an outer peripheral face of a peripheral wall of the scroll portion;

the reinforcement portion has a slit portion that makes the reinforcement portion partially discontinuous in a circumferential direction; and the pillar portion is provided on a travel path of a fragment of the wheel moving from a main body of the wheel toward the slit portion.

2. A turbocharger wheel housing comprising a shell body having a scroll portion and a base body having an accommodation portion in which a wheel is accommodated, wherein a gas passage formed between the shell body and the base body, wherein:

the shell body is composed of a first shell body and a second shell body that are formed separately from each other and combined with each other;

the second shell body includes the scroll portion;

the accommodation portion includes a wheel chamber in which the wheel is arranged, a communication portion that allows a gas to flow from the gas passage to the wheel chamber, and a pillar portion provided adjacent to the communication portion to block flow of the gas from the gas passage to the wheel chamber;

the first shell body includes a reinforcement portion superposed on one of an inner peripheral face or an outer peripheral face of a peripheral wall of the scroll portion;

the reinforcement portion has a slit portion that makes the reinforcement portion partially discontinuous in a circumferential direction; and the pillar portion is so provided as to intersect with that tangential line of the wheel which passes the slit portion.

3. A turbocharger wheel housing comprising:

a shell body having a scroll portion and a base body having an accommodation portion in which a wheel is accommodated, and in which a gas passage formed between the shell body and the base body, wherein:

the shell body is composed of a first shell body and a second shell body that are formed separately from each other and combined with each other;

the second shell body includes the scroll portion;

the accommodation portion includes a wheel chamber in which the wheel is arranged, a communication portion that allows a gas to flow from the gas passage to the wheel chamber, and a pillar portion provided adjacently to the communication portion to block flow of the gas from the gas passage to the wheel chamber;

the first shell body includes a reinforcement portion superposed on one of an inner peripheral face or an outer peripheral face of a peripheral wall of the scroll portion;

the reinforcement portion has a slit portion that is partially discontinuous in a circumferential direction; and the pillar portion is so provided as to prevent a fragment of the wheel, which separates from a main body of the wheel and moves toward a thin-walled portion of a peripheral wall of the shell body, from hitting the thin-walled portion, the thin-walled portion being that region of the peripheral wall of the shell body where a peripheral wall of the scroll portion and the slit portion are superposed on each other.

4. The turbocharger wheel housing according to claim 1, wherein the first shell body and the second shell body are provided as sheet metal shell bodies.

5. The turbocharger wheel housing according to claim 1, wherein the shell body includes a connection portion that connects the scroll portion with an exhaust pipe or an intake pipe, the first shell body includes a first divisional connection portion as part of the connection portion, the second shell body includes a second divisional connection portion that forms part of the connection portion, and the connection portion is composed of the first divisional connection portion and the second divisional connection portion that are combined with each other.

6. The turbocharger wheel housing according to claim 5, wherein the first shell body is formed of a metal plate having an oblong flat plate portion and a protrusion portion that protrudes from a long side of the flat plate portion, the reinforcement portion is formed by working the flat plate portion into a cylindrical shape, and the first divisional connection portion is obtained by working the protrusion portion into a circular shape.

7. The turbocharger wheel housing according to claim 1, wherein the base body includes a flange portion which protrudes radially outward beyond the accommodation portion, and the wheel housing is formed by fitting one of the reinforcement portion of the first shell body and the scroll portion of the second shell body to an outer periphery of the flange portion of the base body and fitting the other of the reinforcement portion and the scroll portion to an inner periphery of the one of the reinforcement portion and the scroll portion that is fitted to the outer periphery of the flange portion.

8. The turbocharger wheel housing according to claim 1, wherein the pillar portion is longer in a circumferential direction than the slit portion.

9. A turbocharger turbine housing, comprising:

a shell body having a scroll portion and a base body having an accommodation portion in which a turbine wheel is accommodated, wherein a gas passage formed between the shell body and the base body, wherein:

the shell body is composed of a first shell body and a second shell body that are formed separately from each other and combined with each other;

the second shell body includes the scroll portion;

the accommodation portion includes a turbine chamber in which the turbine wheel is arranged, a communication portion that allows a gas to flow from the gas passage to the turbine chamber, and a pillar portion provided adjacent to the communication portion to block flow of the gas from the gas passage to the turbine chamber;

the first shell body includes a reinforcement portion superposed on one of an inner peripheral face or an outer peripheral face of a peripheral wall of the scroll portion;

the reinforcement portion has a slit portion that makes the reinforcement portion partially discontinuous in a circumferential direction; and the pillar portion is provided on a travel path of a fragment of the turbine wheel moving from a main body of the turbine wheel toward the slit portion.

10. A turbocharger compressor housing, comprising:

a shell body having a scroll portion and a base body having an accommodation portion in which a compressor wheel is accommodated, wherein a gas passage formed between the shell body and the base body, wherein:

the shell body is composed of a first shell body and a second shell body that are formed separately from each other and combined with each other;

the second shell body includes the scroll portion;

the accommodation portion includes a compressor chamber in which the compressor wheel is arranged, a communication portion that allows a gas to flow from the gas passage to the compressor chamber, and a pillar portion provided adjacent to the communication portion to block flow of the gas from the gas passage to the compressor chamber;

the first shell body includes a reinforcement portion superposed on one of an inner peripheral face or an outer peripheral face of a peripheral wall of the scroll portion;

the reinforcement portion has a slit portion that makes the reinforcement portion partially discontinuous in a circumferential direction; and the pillar portion is provided on a travel path of a fragment of the compressor wheel moving from, a main body of the compressor wheel toward the slit portion.

11. A turbocharger including the wheel housing according to claim 1.

12. The turbocharger wheel housing according to claim 2, characterized in that the first shell body and the second shell body are provided as sheet metal shell bodies.

13. The turbocharger wheel housing according to claim 2, characterized in that the shell body includes a connection portion that connects the scroll portion with an exhaust pipe or an intake pipe, the first shell body includes a first divisional connection portion as part of the connection portion, the second shell body includes a second divisional connection portion that forms part of the connection portion, and the connection portion is composed of the first divisional connection portion and the second divisional connection portion that are combined with each other.

14. The turbocharger wheel housing according to claim 13, characterized in that the first shell body is formed of a metal plate having an oblong flat plate portion and a protrusion portion that protrudes from a long side of the flat plate portion, the reinforcement portion is formed by working the flat plate portion into a cylindrical shape, and the first divisional connection portion is obtained by working the protrusion portion into a circular shape.

15. The turbocharger wheel housing according to claim 2, characterized in that the base body includes a flange portion which protrudes radially outward beyond the accommodation portion, and the wheel housing is formed by fitting one of the reinforcement portion of the first shell body and the scroll portion of the second shell body to an outer periphery of the flange portion of the base body and fitting the other of the reinforcement portion and the scroll portion to an inner periphery of the one of the reinforcement portion and the scroll portion that is fitted to the outer periphery of the flange portion.

16. The turbocharger wheel housing according to claim 2, characterized in that the pillar portion is longer in a circumferential direction than the slit portion.

17. A turbocharger turbine housing, comprising:

a shell body having a scroll portion and a base body having an accommodation portion in which a turbine wheel is accommodated, wherein a gas passage formed between the shell body and the base body, wherein:

the shell body is composed of a first shell body and a second shell body that are formed separately from each other and combined with each other;

the second shell body includes the scroll portion;

the accommodation portion includes a turbine wheel chamber in which the turbine wheel is arranged, a communication portion that allows a gas to flow from the gas passage to the turbine wheel chamber, and a pillar portion provided adjacent to the communication portion to block flow of the gas from the gas passage to the turbine wheel chamber;

the first shell body includes a reinforcement portion superposed on one of an inner peripheral face or an outer peripheral face of a peripheral wall of the scroll portion, the reinforcement portion has a slit portion that makes the reinforcement portion partially discontinuous in a circumferential direction; and the pillar portion is so provided as to intersect with that tangential line of the turbine wheel which passes the slit portion.

18. A turbocharger compressor housing, comprising:

a shell body having a scroll portion and a base body having an accommodation portion in which a compressor wheel is accommodated, wherein a gas passaged formed between the shell body and the base body, wherein:

the shell body is composed of a first shell body and a second shell body that are formed separately from each other and combined with each other;

the second shell body includes the scroll portion;

the accommodation portion includes a compressor wheel chamber in which the compressor wheel is arranged, a communication portion that allows a gas to flow from the gas passage to the compressor wheel chamber, and a pillar portion provided adjacent to the communication portion to block flow, of the gas from the gas passage to the compressor wheel chamber;

the first shell body includes a reinforcement portion superposed on one of an inner peripheral face or an outer peripheral face of a peripheral wall of the scroll portion, the reinforcement portion has a slit portion that makes the reinforcement portion partially discontinuous in a circumferential direction; and the pillar portions is so provided as to intersect with that tangential line of the compressor wheel which passes the slit portion.

19. A turbocharger including the wheel housing according to claim 2.

20. The turbocharger wheel housing according to claim 3, characterized in that the first shell body and the second shell body are provided as sheet metal shell bodies.

21. The turbocharger wheel housing according to claim 3, characterized in that the shell body includes a connection portion that connects the scroll portion with an exhaust pipe or an intake pipe, the first shell body includes a first divisional connection portion as part of the connection portion, the second shell body includes a second divisional connection portion that forms part of the connection portion, and the connection portion is composed of the first divisional connection portion and the second divisional connection portion that are combined with each other.

22. The turbocharger wheel housing according to claim 21, characterized in that the first shell body is formed of a metal plate having an oblong flat plate portion and a protrusion portion that protrudes from a long side of the flat plate portion, the reinforcement portion is formed by working the flat plate portion into a cylindrical shape, and the first divisional connection portion is obtained by working the protrusion portion into a circular shape.

23. The turbocharger wheel housing according to claim 3, characterized in that the base body includes a flange portion which protrudes radially outward beyond the accommodation portion, and the wheel housing is formed by fitting one of the reinforcement portion of the first shell body and the scroll portion of the second shell body to an outer periphery of the flange portion of the base body and fitting the other of the reinforcement portion and the scroll portion to an inner periphery of the one of the reinforcement portion and the scroll portion that is fitted to the outer periphery of the flange portion.

24. The turbocharger wheel housing according to claim 3, characterized in that the pillar portion is longer in a circumferential direction than the slit portion.

25. A turbocharger turbine housing, comprising:

a shell body having a scroll portion and a base body having an accommodation portion in which a turbine wheel is accommodated, and in which a gas passage formed between the shell body and the base body, wherein:

the shell body is composed of a first shell body and a second shell body that are formed separately from each other and combined with each other;

the second shell body includes the scroll portion;

the accommodation portion includes a turbine wheel chamber, in which the turbine wheel is arranged, a communication portion that allows a gas to flow from the gas passage to the turbine wheel chamber, and a pillar portion provided adjacently to the communication portion to block flow of the gas from the gas passage to the turbine wheel chamber;

the first shell body includes a reinforcement portion superposed on one of an inner peripheral face or an outer peripheral face of a peripheral wall of the scroll portion;

the reinforcement portion has a slit portion that is partially discontinuous in a circumferential direction; and the pillar portion is so provided as to prevent a fragment of the turbine wheel, which separates from a main body of the turbine wheel and moves toward a thin-walled portion of a peripheral wall of the shell body, from hitting the thin-walled portion, the thin-walled portion being that region of the peripheral wall of the shell body where a peripheral wall of the scroll portion and the slit portion are superposed on each other.

26. A turbocharger compressor housing, comprising:

a shell body having a scroll portion and a base body having an accommodation portion in which a compressor wheel is accommodated, and in which a gas passage formed between the shell body and the base body, wherein:

the shell body is composed of a first shell body and a second shell body that are formed separately from each other and combined with each other;

the second shell body includes the scroll portion;

the accommodation portion includes a compressor wheel chamber in which the compressor wheel is arranged, a communication portion that allows a gas to flow from the gas passage to the compressor wheel chamber, and a pillar portion provided adjacently to the communication portion to block flow of the gas from the gas passage to the compressor wheel chamber;

the first shell body includes a reinforcement portion superposed on one of an inner peripheral face or an outer peripheral face of a peripheral wall of the scroll portion;

the reinforcement portion has a slit portion that is partially discontinuous in a circumferential direction; and the pillar portion is so provided as to prevent a fragment of the compressor wheel, which separates from a main body of the compressor wheel and moves toward a thin-walled portion of a peripheral wall of the shell body, from hitting the thin-walled portion, the thin-walled portion being that region of the peripheral wall of the shell body where a peripheral wall of the scroll portion and the slit portion are superposed on each other.

27. A turbocharger including the wheel housing according to claim 3.

* * * * *